US012435732B1

(12) United States Patent
Sondur et al.

(10) Patent No.: US 12,435,732 B1
(45) Date of Patent: Oct. 7, 2025

(54) CENTRIFUGAL BLOWER HOUSING

(71) Applicant: Microsoft Technology Licensing, LLC, Redmond, WA (US)

(72) Inventors: Sneha Rajeev Sondur, Seattle, WA (US); Sudeendra Durgappa, Bellevue, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 18/890,486

(22) Filed: Sep. 19, 2024

(51) Int. Cl.
*F04D 29/42* (2006.01)

(52) U.S. Cl.
CPC ..... *F04D 29/422* (2013.01); *F04D 29/4226* (2013.01); *F04D 29/4246* (2013.01)

(58) Field of Classification Search
CPC . F04D 29/422; F04D 29/4226; F04D 29/4246
See application file for complete search history.

(56) References Cited

U.S. PATENT DOCUMENTS

| | | | |
|---|---|---|---|
| 4,722,669 | A | 2/1988 | Kundert |
| 4,924,937 | A | 5/1990 | Beal |
| 5,448,143 | A | 9/1995 | Pecone |
| 5,567,114 | A | 10/1996 | Wallace |
| 5,676,198 | A | 10/1997 | Schneider |
| 5,793,611 | A | 8/1998 | Nakazato |
| 5,923,262 | A | 7/1999 | Fuss |
| 5,934,368 | A | 8/1999 | Tanaka |
| 5,950,714 | A | 9/1999 | Schneider |
| 6,034,872 | A | 3/2000 | Chrysler |
| 6,184,504 | B1 | 2/2001 | Cardella |
| 6,212,069 | B1 | 4/2001 | Janik et al. |
| 6,213,195 | B1 | 4/2001 | Downing |
| 6,319,114 | B1 | 11/2001 | Nair |
| 6,522,992 | B1 | 2/2003 | Mccall |
| 6,816,371 | B2 | 11/2004 | Agata et al. |
| 6,934,864 | B2 | 8/2005 | Chu |
| 6,942,018 | B2 | 9/2005 | Goodson |
| 6,982,873 | B2 | 1/2006 | Meyer |
| 7,134,486 | B2 | 11/2006 | Santiago |
| 7,187,548 | B2 | 3/2007 | Meyer |
| 7,203,062 | B2 | 4/2007 | Tsuji |
| 7,312,992 | B2 | 12/2007 | Jory |
| 7,525,798 | B2 | 4/2009 | Schultz |
| 7,527,409 | B2 | 5/2009 | Atarashi |
| 7,726,186 | B2 | 6/2010 | Nair |

(Continued)

FOREIGN PATENT DOCUMENTS

| | | | |
|---|---|---|---|
| CN | 112513468 | B | 2/2023 |
| GB | 2402205 | A | 12/2004 |

OTHER PUBLICATIONS

Marinov, et al., "Determining Angle Position of an Object Using accelerometers", Retrieved from Internet URL:—http://ecad.tusofia.bg/et/2005/pdf/Paper126-M_Marinov.pdf>>, Electronics, vol. 3, Sep. 21-23, 2005, pp. 184-189.

*Primary Examiner* — Sabbir Hasan
(74) *Attorney, Agent, or Firm* — Alleman Hall & Tuttle LLP

(57) ABSTRACT

A housing for a centrifugal blower comprises a first wall and a second wall forming a primary exit, and a third wall and a fourth wall forming a secondary exit. A volute tongue is located between the second wall and the fourth wall. A moveable flap is pivotally coupled at the volute tongue and extends toward the primary exit.

18 Claims, 6 Drawing Sheets

(56) References Cited

U.S. PATENT DOCUMENTS

| | | | | |
|---|---|---|---|---|
| 7,903,409 | B2 | 3/2011 | Patel | |
| 8,059,405 | B2 | 11/2011 | Campbell et al. | |
| 8,164,434 | B2 | 4/2012 | Gross | |
| 8,206,099 | B2 * | 6/2012 | Tsai | F04D 29/4246 415/206 |
| 8,274,228 | B2 | 9/2012 | Macdonald | |
| 8,305,728 | B2 | 11/2012 | Lee | |
| 8,315,746 | B2 | 11/2012 | Cox | |
| 8,395,898 | B1 | 3/2013 | Chamseddine | |
| 8,712,598 | B2 | 4/2014 | Dighde | |
| 11,536,286 | B2 * | 12/2022 | Shah | G06F 1/203 |
| 2003/0133259 | A1 | 7/2003 | Meyer | |
| 2003/0151893 | A1 | 8/2003 | Meyer | |
| 2004/0262409 | A1 | 12/2004 | Crippen | |
| 2005/0209740 | A1 | 9/2005 | Vann, Jr. | |
| 2006/0113066 | A1 | 6/2006 | Mongia | |
| 2006/0114652 | A1 | 6/2006 | Jory | |
| 2007/0268667 | A1 | 11/2007 | Moorer | |
| 2008/0060794 | A1 | 3/2008 | Wei | |
| 2008/0192428 | A1 | 8/2008 | Clayton | |
| 2008/0198896 | A1 | 8/2008 | Nair | |
| 2008/0269954 | A1 | 10/2008 | Lev | |
| 2008/0313492 | A1 | 12/2008 | Hansen | |
| 2009/0021908 | A1 | 1/2009 | Patel | |
| 2009/0316103 | A1 | 12/2009 | Nose | |
| 2009/0321044 | A1 | 12/2009 | Hernon | |
| 2011/0079376 | A1 | 4/2011 | Loong | |
| 2011/0116206 | A1 | 5/2011 | Kim | |
| 2011/0139401 | A1 | 6/2011 | Huang | |
| 2011/0157813 | A1 | 6/2011 | Macdonald | |
| 2011/0292560 | A1 | 12/2011 | Jewell-Larsen et al. | |
| 2012/0002342 | A1 | 1/2012 | Lee | |
| 2012/0026692 | A1 | 2/2012 | Loong | |
| 2012/0111027 | A1 | 5/2012 | Campbell | |
| 2012/0111034 | A1 | 5/2012 | Campbell | |
| 2012/0120542 | A1 | 5/2012 | Zhang | |
| 2012/0130545 | A1 | 5/2012 | Haugh et al. | |
| 2012/0162903 | A1 | 6/2012 | Macdonald | |
| 2012/0175663 | A1 | 7/2012 | Lee | |
| 2012/0205079 | A1 | 8/2012 | Jewell-Larsen et al. | |
| 2012/0241140 | A1 | 9/2012 | Macdonald | |
| 2012/0268857 | A1 | 10/2012 | Jewell-Larsen | |
| 2013/0021750 | A1 | 1/2013 | Senatori | |
| 2018/0284858 | A1 | 10/2018 | Lee | |
| 2023/0125348 | A1 | 4/2023 | Kulkarni | |

* cited by examiner

CENTRIFUGAL BLOWER HOUSING

BACKGROUND

Electronic devices can utilize one or more blowers and vents for active cooling. In some use cases a vent can be obstructed, thereby impacting the efficiency of the blower's performance.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

In some examples, a housing for a centrifugal blower comprises a first wall and a second wall forming a primary exit, and a third wall and a fourth wall forming a secondary exit. A volute tongue is located between the second wall and the fourth wall. A moveable flap is pivotally coupled at the volute tongue and extends toward the primary exit.

In some examples, a centrifugal blower for use in an electronic device comprises an impeller and a housing enclosing the impeller. The housing comprises a first wall and a second wall forming a primary exit, and a third wall and a fourth wall forming a secondary exit. A volute tongue is located between the second wall and the fourth wall. A moveable flap is pivotally coupled at the volute tongue and extends toward the primary exit.

In some examples, a method of increasing static pressure in a centrifugal blower is provided. The centrifugal blower comprises a primary volute, a secondary volute, and a moveable flap pivotally coupled adjacent to the secondary volute. The method includes producing an unmodified static pressure in the centrifugal blower by operating the blower with the moveable flap in a closed position that at least partially defines an unmodified secondary volute. A modified static pressure greater than the unmodified static pressure is produced in the centrifugal blower by operating the blower with the moveable flap pivoted to an open position that at least partially defines a modified secondary volute.

DETAILED DESCRIPTION

Electronic devices can utilize one or more blowers and vents for active cooling. For example, some computing devices utilize a blower that directs airflow inside the device to dual exhaust exits. In some use cases, an exhaust exit of a device can become partially or fully obstructed, thereby imposing a secondary impedance on the internal airflow and reducing the air circulation and flow rate through the device. This correspondingly causes increasing temperatures in the device that can trigger corrective actions, such as throttling power and performance of the device. These situations and their undesirable effects can be pronounced in thin form factor devices that naturally exhibit relatively higher impedances to air flow.

Accordingly, and to address one or more of these shortcomings, the present disclosure describes housings for centrifugal blowers and related methods that selectively increase static pressure in the blower to correspondingly increase air flow rates within and through the device. As will be described in more detail below, housings of the present disclosure comprise a first wall and a second wall forming a primary exit, and a third wall and a fourth wall forming a secondary exit. A volute tongue is located between the second wall and the fourth wall. A moveable flap is pivotally coupled at the volute tongue and extends toward the primary exit. With these configurations, the moveable flap can be selectively pivoted towards the first wall between a closed position and an open position that advantageously increases static pressure and correspondingly air flow in the blower.

Figure 1:
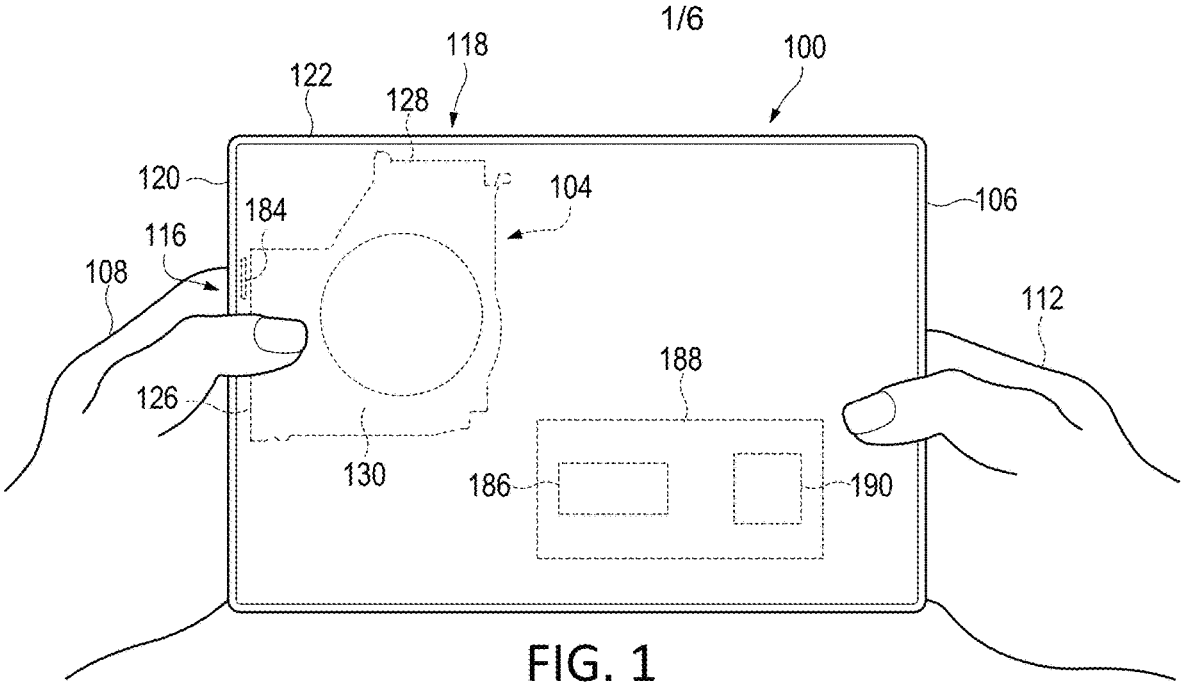
FIG. 1 depicts an example computing device including a centrifugal blower and blower housing according to examples of the present disclosure.

FIG. 1 depicts an example electronic device in the form of a computing device 100 that includes a centrifugal blower 104 housed in chassis 106 of the computing device according to aspects of the present disclosure. In the present example computing device 100 comprises a tablet computing device configured to be held in hands 108, 112 of a user. In other examples, centrifugal blowers and their housings of the present disclosure can be utilized with a wide variety of other types and form factors of electronic devices, including but not limited to laptop devices, hybrid or 2-in-1 devices with detachable keyboards, gaming devices, desktop devices, wearable electronic device, displays, televisions, and household appliances. For example, portable computing devices having thin form factors can benefit from utilizing small, thin, and efficient thermal management devices such as embodiments of centrifugal blowers described herein.

Figure 2:
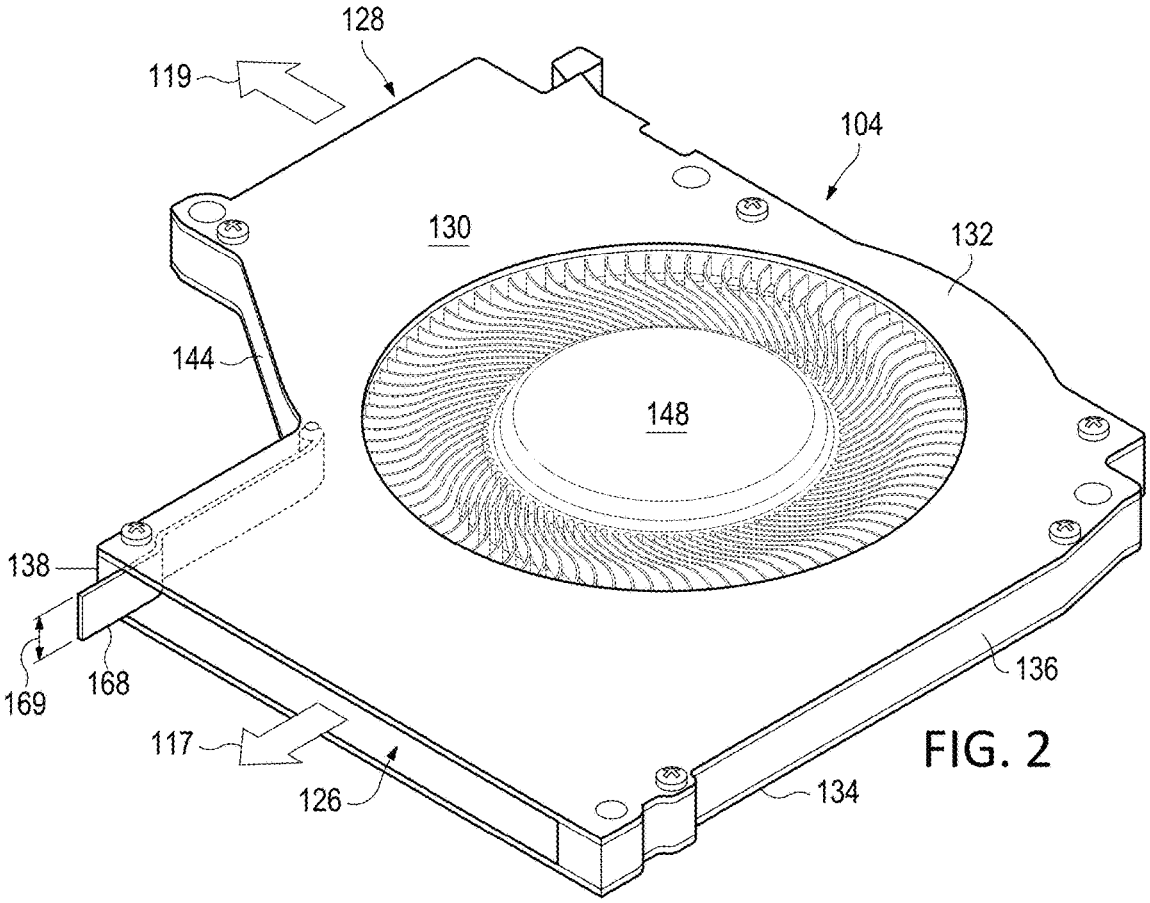
FIG. 2 depicts the example blower and blower housing of FIG. 1 according to examples of the present disclosure.

In the present example, computing device 100 comprises a primary exhaust port 116 and a secondary exhaust port 118 formed in corresponding first and second side walls 120, 122 of the chassis 106. With reference also to FIG. 2 and described in more detail below, blower 104 includes a primary exit 126 oriented to direct air flow towards the primary exhaust port 116 in a first direction (as indicated by arrow 117), and a secondary exit 128 oriented to direct air flow towards the secondary exhaust port 118 in a second direction 119 substantially orthogonal to the first direction. Computing device 100 also includes one or more inlet ports (not shown) through which air can be ingested and circulated by the blower 104 to cool components of the device.

Figure 3:
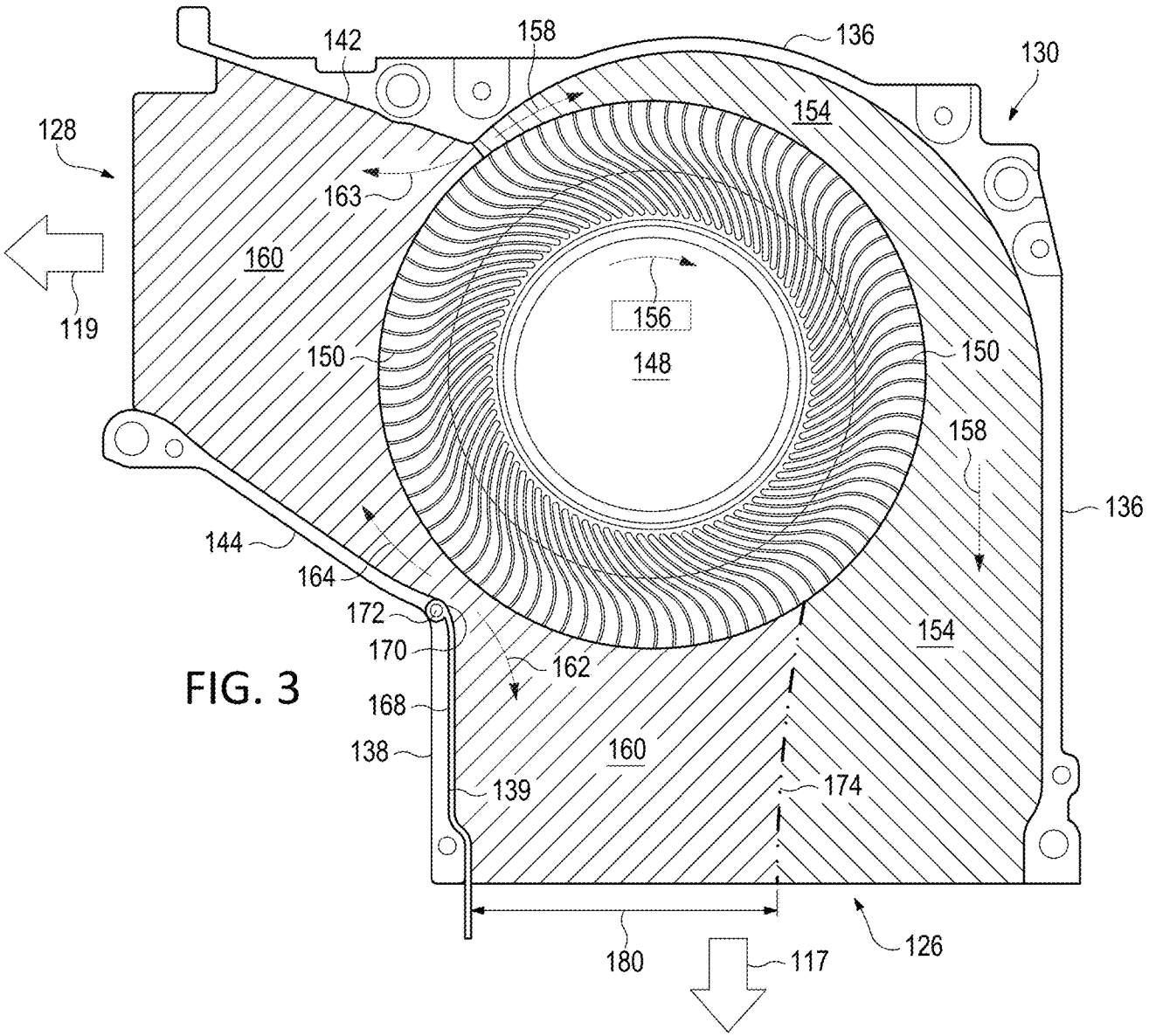
FIG. 3 shows the blower of FIG. 2 with one cover of the housing removed and the moveable flap in a closed position according to examples of the present disclosure.

With reference now to FIGS. 2 and 3, in the present example the centrifugal blower 104 includes a housing 130 comprising first cover 132 and opposing second cover 134 spaced from the first cover. A first wall 136 extends from a first side of the primary exit 126 around to a rear side of the blower 104. A second wall 138 is located opposite to the first wall 136 at the primary exit 126. In this example at least a portion of the first wall and the second wall are substantially parallel. As illustrated in FIGS. 2 and 3, the first wall 136 and second wall 138, along with first cover 132 and opposing second cover 134, form the primary exit 126.

With reference to FIG. 3, housing 130 further includes a third wall 142 extending from a terminal point of the first wall 136 at the rear side of the blower 104. A fourth wall 144 is located opposite to the third wall 142. In this manner, the third wall 142 and fourth wall 144, along with first cover 132 and opposing second cover 134, form the secondary exit 128.

An impeller 148 is mounted in the housing 130 and operable to intake air inside the chassis 106 of computing device 100 and discharge the air through primary exit 126 and secondary exit 128. By imparting radial and rotary motion to the air, impeller blades 150 of impeller 148 direct the air to the outer periphery of housing 130. With reference to FIG. 3, in this example the impeller blades 150 and first wall 136 cooperate to form a primary volute 154 that begins at the rear side of housing 130 and extends to the primary exit 126. More particularly, a distance between the impeller blades 150 and first wall 136 increases in the rotational direction of the blades, indicated by arrow 156. Air flow within primary volute 154 generally proceeds in the direction of action arrows 158 toward primary exit 126. For clarity it is noted that the parallel lines depicted inside the primary volute 154 are not cross-sectional lines indicating structure, but instead are provided to help illustrate the area of the primary volute.

Figure 4:
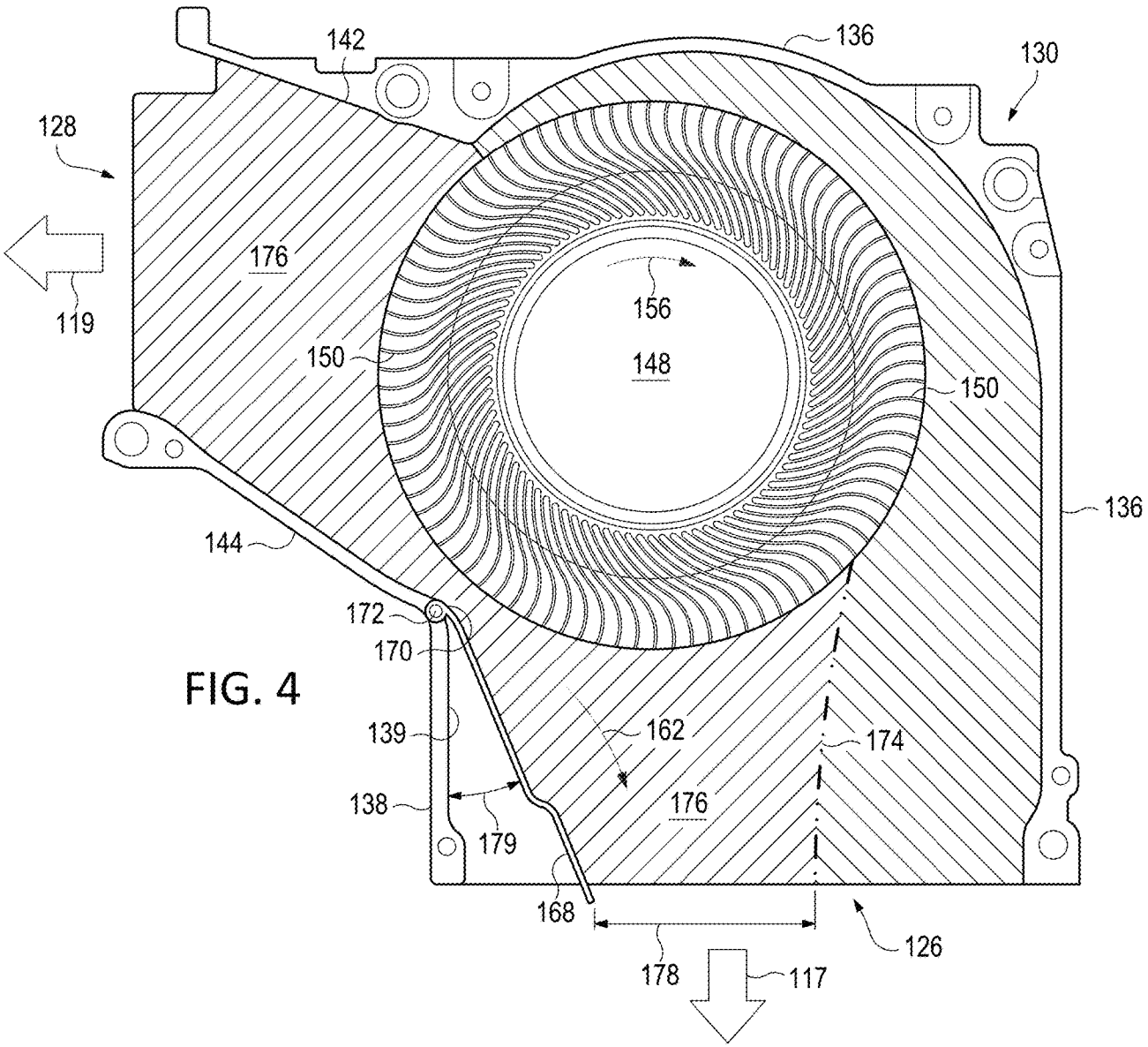
FIG. 4 shows the blower of FIG. 3 with the moveable flap pivoted to an open position according to examples of the present disclosure.

In one potential advantage of the present disclosure described further below, housing 130 of centrifugal blower 104 includes a moveable flap 168 pivotally coupled at the volute tongue 170 between second wall 138 and fourth wall 144. As shown in FIG. 3, second wall 138 and fourth wall 144 meet at the volute tongue 170. In FIGS. 2 and 3 the moveable flap 168 is in a closed position substantially parallel to the second wall 138. In the present example, the moveable flap 168 in this closed position is flat against an interior surface 139 of the second wall 138. As shown in FIGS. 2 and 3, the moveable flap 168 extends from its pivot point 172 toward the primary exit 126. As illustrated in FIG. 2, the moveable flap has a width 169 that extends substantially between the first cover 132 and the opposing second cover 134 of the housing 130. Advantageously and as described further below, the moveable flap is configured to pivot towards the first wall 136 between the closed position and an open position that defines an open angle between the moveable flap and the second wall 138 (as shown in FIG. 4). And by utilizing a width 169 that extends substantially between the first cover 132 and the opposing second cover 134, when pivoted away from interior surface 139 of the second wall 138, the moveable flap 168 minimizes any gaps at the first cover 132 and second cover 134 to correspondingly reduce any airflow past the moveable flap.

With reference again to FIG. 3, with the moveable flap 168 in the closed position, impeller blades 150 of impeller 148 along with the moveable flap cooperate to form an unmodified secondary volute 160 that directs air through both the primary exit 126, as generally indicated by arrow 162, and through secondary exit 128 as generally indicated by arrows 163, 164. Operating the centrifugal blower 104 at a given power with the moveable flap 168 in the closed position produces an unmodified static pressure in the centrifugal blower. For clarity it is noted that the parallel lines inside the unmodified secondary volute 160 are not cross-sectional lines indicating structure, but instead are provided to help depict the area of the secondary volute. In FIG. 3 dividing line 174 generally indicates a boundary between the primary volute 154 and the unmodified secondary volute 160.

As noted above, in some use case examples one or more exhaust exits of computing device 100 can become partially or fully obstructed. For example, FIG. 1 schematically illustrates a user holding computing device 100 in a manner that causes the user's left hand 108 to partially obstruct the primary exhaust port 116 of computing device 100 and corresponding primary exit 126 of the housing 130, thereby imposing additional impedance on the airflow through centrifugal blower 104 and reducing air circulation and flow rate through the device. Such reduced flow rates can cause increasing temperatures in the device that can trigger corrective actions, such as undesirably throttling power and performance of device components, such as one or more processors, displays, etc. It will be appreciated that the orientation of centrifugal blower 104, primary exit 126 and secondary exit 128, primary exhaust port 116 and secondary exhaust port 118, and the orientation of hands 108 and 112 in FIG. 1 are merely illustrative examples, and the present disclosure covers a variety of other component arrangements and holding orientations.

Accordingly, in one potential advantage of the present disclosure and with reference to FIG. 4, when the centrifugal blower 104 experiences increased impedance to airflow through the blower, for example resulting from an obstruction at the primary exit 126 and/or secondary exit 128, the moveable flap 168 can be pivoted to the open position shown in FIG. 4, whereby the moveable flap and the impeller 148 define a portion of a modified secondary volute 176. With reference to FIGS. 3 and 4, the portion of the modified secondary volute 176 has a modified width 178 at the primary exit 126 that is less than an unmodified width 180 of the unmodified secondary volute 160 at the primary exit. In this example with moveable flap 168 in the open position, the width of the primary volute is also lessened as the dividing line 174 is shifted towards the first wall 136. In the present example, an angle 179 with the second wall 138 formed by the moveable flap 168 in the open position is approximately 22 degrees. In other examples and configurations of housing 130, different angles between the moveable flap 168 in the open position and the second wall 138 can be utilized.

Advantageously, operating the centrifugal blower 104 at a given power with the moveable flap 168 in this open position to create the modified secondary volute 176 generates a modified static pressure on the impeller 148 that is greater than the unmodified static pressure on the impeller generated by the unmodified secondary volute 160. Correspondingly, the modified secondary volute 176 also generates a modified primary pressure at the primary exit 126 that is greater than an unmodified primary pressure generated at the primary exit by the unmodified secondary volute 160. In this manner, operating the centrifugal blower 104 with the moveable flap 168 in the open position advantageously increases the net operating pressure of the fan and the net airflow rate through the fan, which at least partially offsets the decrease in airflow caused by the increased impedance. Additionally, airflow through both the primary exit 126 and the secondary exit 128 is maintained while operating the centrifugal blower 104 with the moveable flap 168 pivoted to the open position.

Advantageously, the moveable flap 168 can be selectively pivoted to modify the internal structure and the P-Q curve for the centrifugal blower 104. Additionally, by locating the pivot point 172 of the moveable flap 168 at or near the volute tongue 170, pivoting the flap from the closed to the open position narrows the secondary volute to generate higher net pressure at both the primary exit 126 and secondary exit 128 and increased net air flow through the centrifugal blower 104.

In another potential advantage of the present disclosure, the moveable flap 168 can be utilized to generate higher net pressures and increased air flows while also avoiding increased noise by the centrifugal blower 104. More particularly, and by locating the pivot point 172 of the moveable flap 168 at or near the volute tongue 170, in some examples the centrifugal blower 104 generates a first sound pressure level when operating at a given power with the moveable flap in the closed position, and generates a second sound pressure level substantially equivalent to the first sound pressure level when operating at the given power with the moveable flap in the open position. In one example, the change in noise level between the centrifugal blower 104 operating at a given power with the moveable flap in the closed position and operating with the flap in the open position is less than one decibel (dB).

In some examples, the centrifugal blower 104 or computing device 100 can sense an obstruction at the primary exit 126 and/or secondary exit 128. Upon sensing the obstruction, the moveable flap 168 is pivoted to the open position to increase the net pressure and net air flow through the centrifugal blower 104. In one example and with reference again to FIG. 1, a flow meter 184 located at the primary exit 126 of the housing 130 measures the flow rate of air discharging from the primary exit. When the flow rate from the primary exit 126 drops below a predetermined level, a processor 186 of the computing device executes instructions that cause the moveable flap to pivot to the open position. In some examples, computing device 100 includes a printed circuit board 188 that includes a temperature sensor 190 that can detect the temperature of the computing device's external surface. When an obstruction appears at the primary exit 126 and/or secondary exit 128, the airflow through the system is reduced, which causes the external surface temperature to increase, thereby indicating the presence of an obstruction. In these examples, a combination of the flow meter and temperature sensor data can be used to detect the presence of an obstruction.

Figure 5:
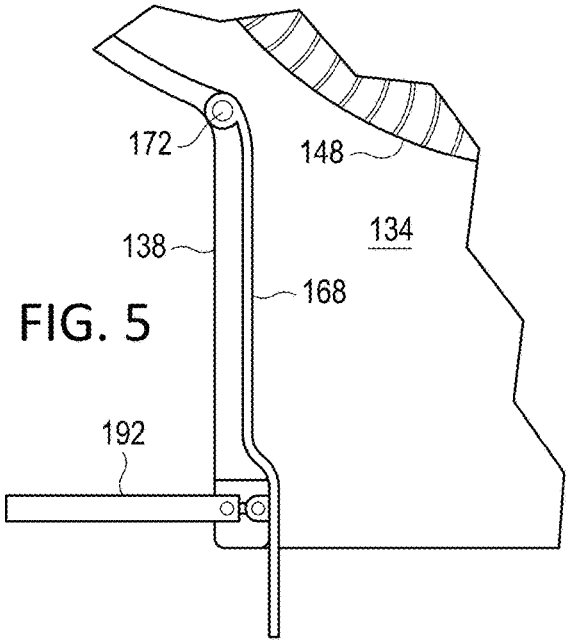
FIGS. 5 and 6 depict an actuator pivoting the moveable flap according to examples of the present disclosure.
Figure 6:
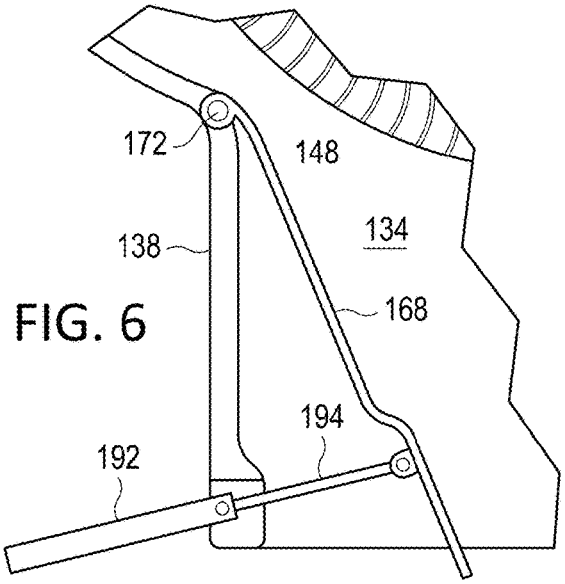

In some examples the housing 130 comprises an actuator coupled to the moveable flap and operable to pivot the moveable flap from the closed position to the open position upon a determination that the primary exit is being at least partially obstructed. With reference to FIGS. 5 and 6, in one example an actuator 192 comprises an extendable piston 194 configured to pivot the moveable flap between the closed position (FIG. 5) and the open position (FIG. 6). In this example, the piston 194 is also controllable to position the moveable flap 168 at any angle between the closed position and the open position.

Figure 7:
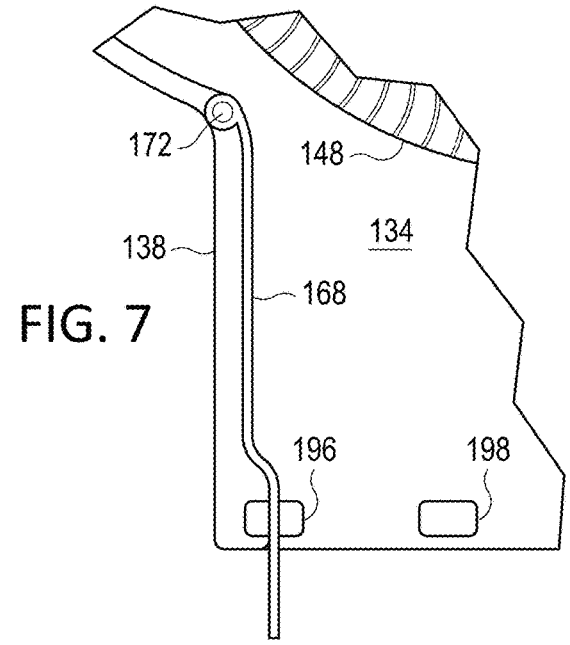
FIGS. 7 and 8 depict another actuator for pivoting the moveable flap according to examples of the present disclosure.
Figure 8:
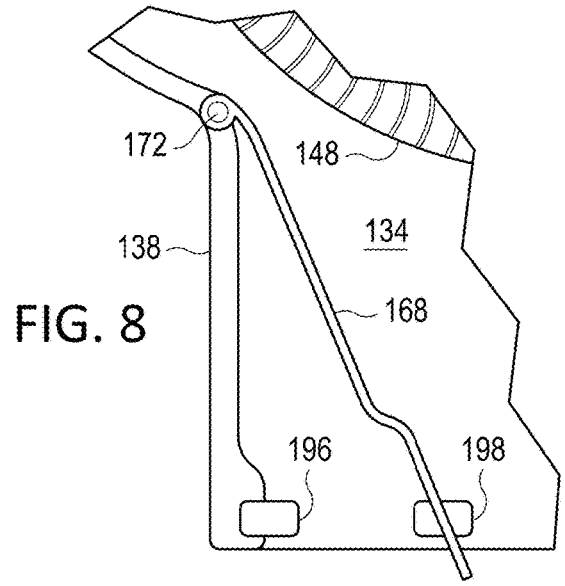

With reference to FIGS. 7 and 8, in another example an actuator comprises a first magnet 196 and a second magnet 198 that can be selectively activated to pivot the moveable flap 168 between the closed position (FIG. 7) and the open position (FIG. 8). In other examples, a variety of other actuation mechanisms can be utilized to pivot the moveable flap 168 between the closed and open positions.

In other examples, housings of the present disclosure can be utilized with a variety of other configurations of dual-exhaust centrifugal blowers having primary and secondary exits, various configurations, shapes, and sizes of impellers, and/or other features.

Figure 9:
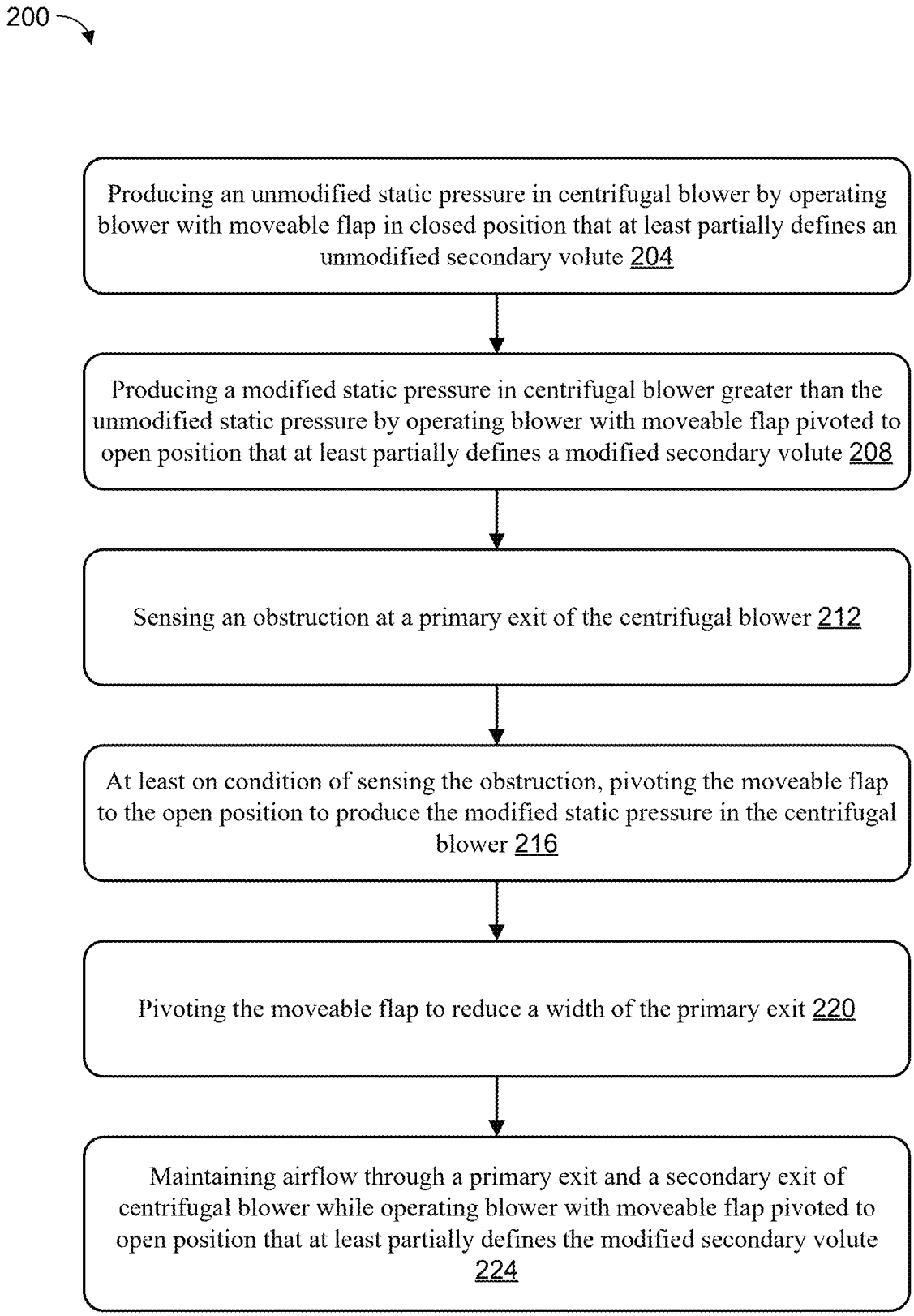
FIG. 9 illustrates an example method of increasing static pressure in a centrifugal blower according to examples of the present disclosure.

FIG. 9 illustrates an example method 200 of increasing static pressure in a centrifugal blower comprising a primary volute, a secondary volute, and a moveable flap pivotally coupled adjacent to the secondary volute. Method 200 may be implemented using the example configurations of centrifugal blower 104 and housing 130 as described above and using other configurations as contemplated by the present disclosure. The following description of method 200 is provided with reference to the components described herein and shown in FIGS. 1-8.

It will be appreciated that the following description of method 200 is provided by way of example and is not meant to be limiting. Therefore, it is to be understood that method 200 may include additional and/or alternative steps relative to those illustrated in FIG. 9. Further, it is to be understood that the steps of method 200 may be performed in any suitable order. Further still, it is to be understood that one or more steps may be omitted from method 200 without departing from the scope of this disclosure. It will also be appreciated that method 200 also may be performed in other contexts using other suitable components.

At 204, method 200 includes producing an unmodified static pressure in the centrifugal blower by operating the blower with the moveable flap in a closed position that at least partially defines an unmodified secondary volute. At 208 method 200 includes producing a modified static pressure in the centrifugal blower greater than the unmodified static pressure by operating the blower with the moveable flap pivoted to an open position that at least partially defines a modified secondary volute. At 212 method 200 includes sensing an obstruction at a primary exit of the centrifugal blower. At 216 method 200 includes, at least on condition of sensing the obstruction, pivoting the moveable flap to the open position to produce the modified static pressure in the centrifugal blower.

At 220 method 200 includes wherein producing the modified static pressure comprises pivoting the moveable flap to reduce a width of the primary exit. At 224 method 200 includes maintaining airflow through a primary exit and a secondary exit of the centrifugal blower while operating the blower with the moveable flap pivoted to the open position that at least partially defines the modified secondary volute.

Figure 10:
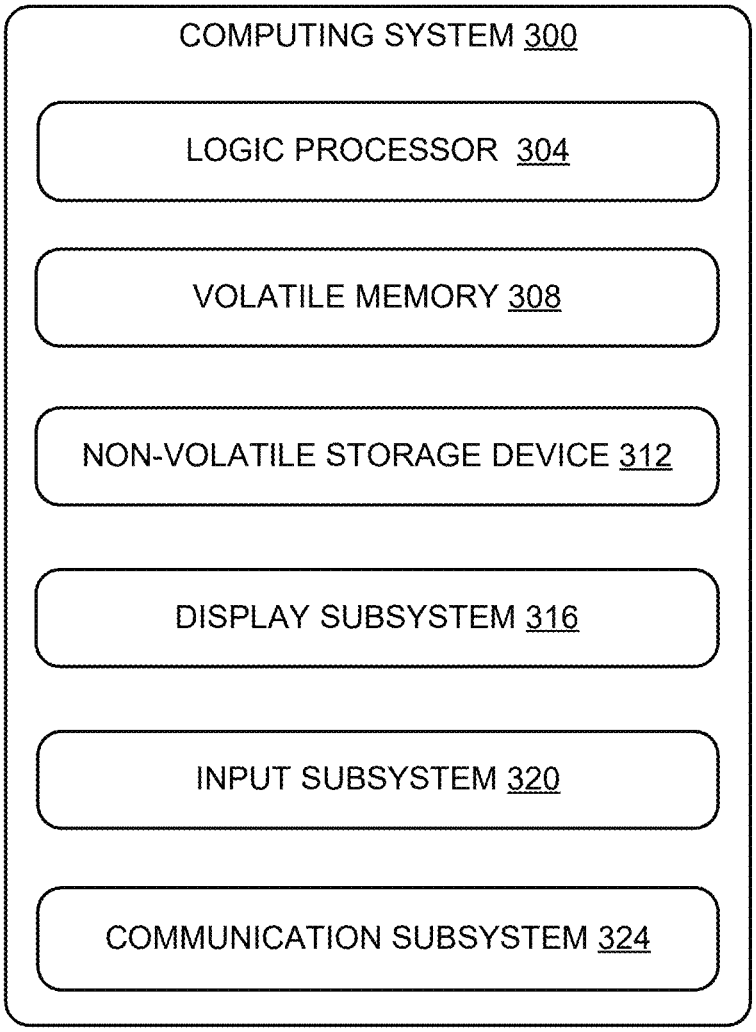
FIG. 10 is a block diagram of an example computing system according to examples of the present disclosure.

FIG. 10 schematically shows a non-limiting embodiment of a computing system 300 shown in simplified form. Computing system 300 may take the form of one or more electronic devices, including but not limited to laptop computers, hybrid or 2-in-1 computers with detachable keyboards, gaming devices or consoles, desktop computers, wearable electronic devices, mobile communication devices (e.g., smart phones), displays, televisions, and household appliances. In the above examples, computing device 100 may comprise computing system 300 or one or more aspects of computing system 300.

Computing system 300 includes a logic processor 304, volatile memory 308, and a non-volatile storage device 312. Computing system 300 may optionally include a display subsystem 316, input subsystem 320, communication subsystem 324, and/or other components not shown in FIG. 10.

Logic processor 304 includes one or more physical devices configured to execute instructions. For example, the logic processor may be configured to execute instructions that are part of one or more applications, services, programs, routines, libraries, objects, components, data structures, or other logical constructs. Such instructions may be implemented to perform a task, implement a data type, transform the state of one or more components, achieve a technical effect, or otherwise arrive at a desired result.

The logic processor 304 may include one or more physical processors (hardware) configured to execute software instructions. Additionally or alternatively, the logic processor may include one or more hardware logic circuits or firmware devices configured to execute hardware-implemented logic or firmware instructions. Processors of the logic processor 304 may be single-core or multi-core, and the instructions executed thereon may be configured for sequential, parallel, and/or distributed processing. Individual components of the logic processor optionally may be distributed among two or more separate devices, which may be remotely located and/or configured for coordinated processing. Aspects of the logic processor may be virtualized and executed by remotely accessible, networked computing devices configured in a cloud-computing configuration. In such a case, these virtualized aspects are run on different physical logic processors of various different machines, it will be understood.

Non-volatile storage device 312 includes one or more physical devices configured to hold instructions executable by the logic processors to implement the methods and processes described herein. When such methods and processes are implemented, the state of non-volatile storage device 312 may be transformed—e.g., to hold different data.

Non-volatile storage device 312 may include physical devices that are removable and/or built-in. Non-volatile storage device 312 may include optical memory (e.g., CD, DVD, HD-DVD, Blu-Ray Disc, etc.), semiconductor memory (e.g., ROM, EPROM, EEPROM, FLASH memory, etc.), and/or magnetic memory (e.g., hard-disk drive, floppy-disk drive, tape drive, MRAM, etc.), or other mass storage device technology. Non-volatile storage device 312 may include nonvolatile, dynamic, static, read/write, read-only, sequential-access, location-addressable, file-addressable, and/or content-addressable devices. It will be appreciated that non-volatile storage device 312 is configured to hold instructions even when power is cut to the non-volatile storage device 312.

Volatile memory 308 may include physical devices that include random access memory. Volatile memory 308 is typically utilized by logic processor 304 to temporarily store information during processing of software instructions. It will be appreciated that volatile memory 308 typically does not continue to store instructions when power is cut to volatile memory 308.

Aspects of logic processor 304, volatile memory 308, and non-volatile storage device 312 may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

When included, display subsystem 316 may be used to present a visual representation of data held by non-volatile storage device 312. As the herein described methods and processes change the data held by the non-volatile storage device, and thus transform the state of the non-volatile storage device, the state of display subsystem 316 may likewise be transformed to visually represent changes in the underlying data. Display subsystem 316 may include one or more display devices utilizing virtually any type of technology. Such display devices may be combined with logic processor 304, volatile memory 308, and/or non-volatile storage device 312 in a shared enclosure, or such display devices may be peripheral display devices.

When included, input subsystem 320 may comprise or interface with one or more user-input devices such as a stylus, touchpad, keyboard, mouse, touch screen, or game controller. In some embodiments, the input subsystem may comprise or interface with selected natural user input (NUI) componentry. Such componentry may be integrated or peripheral, and the transduction and/or processing of input actions may be handled on- or off-board. Example NUI componentry may include a microphone for speech and/or voice recognition; an infrared, color, stereoscopic, and/or depth camera for machine vision and/or gesture recognition; a head tracker, eye tracker, accelerometer, and/or gyroscope for motion detection and/or intent recognition; as well as electric-field sensing componentry for assessing brain activity; and/or any other suitable sensor.

When included, communication subsystem 324 may be configured to communicatively couple various computing devices described herein with each other, and with other devices. Communication subsystem 324 may include wired and/or wireless communication devices compatible with one or more different communication protocols. As non-limiting examples, the communication subsystem may be configured for communication via a wireless telephone network, or a wired or wireless local- or wide-area network, such as a HDMI over Wi-Fi connection. In some embodiments, the communication subsystem may allow computing system 300 to send and/or receive messages to and/or from other devices via a network such as the Internet.

The following paragraphs provide additional support for the claims of the subject application. One aspect provides a housing for a centrifugal blower, the housing comprising: a first wall and a second wall forming a primary exit; a third wall and a fourth wall forming a secondary exit; a volute tongue between the second wall and the fourth wall; and a moveable flap pivotally coupled at the volute tongue and extending toward the primary exit. The housing may additionally or alternatively include, wherein the moveable flap is configured to pivot between a closed position substantially parallel to the second wall and an open position that defines an open angle between the moveable flap and the second wall. The housing may additionally or alternatively include, wherein the first wall and an impeller of the centrifugal blower define a primary volute, the moveable flap in the closed position and the impeller define a portion of an unmodified secondary volute, and the moveable flap in the open position and the impeller define a portion of a modified secondary volute. The housing may additionally or alternatively include, wherein the portion of the modified secondary volute has a modified width at the primary exit that is less than an unmodified width of the unmodified secondary volute at the primary exit. The housing may additionally or alternatively include, wherein the modified secondary volute generates a modified static pressure on the impeller of the centrifugal blower that is greater than an unmodified static pressure generated on the impeller by the unmodified secondary volute. The housing may additionally or alternatively include, wherein the modified secondary volute generates a modified primary pressure at the primary exit that is greater than an unmodified primary pressure generated at the primary exit by the unmodified secondary volute. The housing may additionally or alternatively include, an actuator coupled to the moveable flap, wherein the actuator causes the moveable flap to pivot from the closed position to the open position upon a determination that the primary exit is being at least partially obstructed. The housing may additionally or alternatively include, wherein the moveable flap has a width that extends substantially between a first cover and a second cover of the housing. The housing may additionally or alternatively include, wherein the second wall and the fourth wall meet at the volute tongue.

Another aspect provides a centrifugal blower for use in an electronic device, the centrifugal blower comprising: an impeller; and a housing enclosing the impeller, the housing comprising: a first wall and a second wall forming a primary exit; a third wall and a fourth wall forming a secondary exit; a volute tongue between the second wall and the fourth wall; and a moveable flap pivotally coupled at the volute tongue and extending toward the primary exit. The centrifugal blower may additionally or alternatively include, wherein the moveable flap is configured to pivot towards the first wall between a closed position substantially parallel to the second wall and an open position that defines an open angle between the moveable flap and the second wall. The centrifugal blower may additionally or alternatively include, wherein the first wall and the impeller of the centrifugal blower define a primary volute, the moveable flap in the closed position and the impeller define a portion of an unmodified secondary volute, and the moveable flap in the open position and the impeller define a portion of a modified secondary volute. The centrifugal blower may additionally or alternatively include, wherein the portion of the modified secondary volute has a modified width at the primary exit that is less than an unmodified width of the unmodified secondary volute at the primary exit. The centrifugal blower may additionally or alternatively include, wherein the modified secondary volute generates a modified static pressure on the impeller that is greater than an unmodified static pressure generated on the impeller by the unmodified secondary volute. The centrifugal blower may additionally or alternatively include, wherein the modified secondary volute generates a modified primary pressure at the primary exit that is greater than an unmodified primary pressure generated at the primary exit by the unmodified secondary volute. The centrifugal blower may additionally or alternatively include, wherein the centrifugal blower generates a first sound pressure level when operating at a given power with the moveable flap in the closed position, and the centrifugal blower generates a second sound pressure level substantially equivalent to the first sound pressure level when operating at the given power with the moveable flap in the open position.

Another aspect provides a method of increasing static pressure in a centrifugal blower comprising a primary volute, a secondary volute, and a moveable flap pivotally coupled adjacent to the secondary volute, the method comprising: producing an unmodified static pressure in the centrifugal blower by operating the blower with the moveable flap in a closed position that at least partially defines an unmodified secondary volute; and producing a modified static pressure in the centrifugal blower greater than the unmodified static pressure by operating the blower with the moveable flap pivoted to an open position that at least partially defines a modified secondary volute. The method may additionally or alternatively include sensing an obstruction at a primary exit of the centrifugal blower; and at least on condition of sensing the obstruction, pivoting the moveable flap to the open position to produce the modified static pressure in the centrifugal blower. The method may additionally or alternatively include, wherein producing the modified static pressure comprises pivoting the moveable flap to reduce a width of the primary exit. The method may additionally or alternatively include maintaining airflow through a primary exit and a secondary exit of the centrifugal blower while operating the blower with the moveable flap pivoted to the open position that at least partially defines the modified secondary volute.

It will be understood that the configurations and/or approaches described herein are exemplary in nature, and that these specific embodiments or examples are not to be considered in a limiting sense, because numerous variations are possible.

The subject matter of the present disclosure includes all novel and non-obvious combinations and sub-combinations of the various processes, systems and configurations, and other features, functions, acts, and/or properties disclosed herein, as well as any and all equivalents thereof.

The claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure. As used herein, the phrase "and/or" means any or all of multiple stated possibilities.

The invention claimed is:

1. A housing for a centrifugal blower, the housing comprising:

a first wall and a second wall forming a primary exit;

a third wall and a fourth wall forming a secondary exit;

a volute tongue between the second wall and the fourth wall; and a moveable flap pivotally coupled at the volute tongue and extending toward the primary exit, wherein the moveable flap is configured to pivot between a closed position in which the moveable flap is flat against an interior surface of the second wall and an open position that defines an open angle between the moveable flap and the second wall.

2. The housing of claim 1, wherein the first wall and an impeller of the centrifugal blower define a primary volute, the moveable flap in the closed position and the impeller define a portion of an unmodified secondary volute, and the moveable flap in the open position and the impeller define a portion of a modified secondary volute.

3. The housing of claim 2, wherein the portion of the modified secondary volute has a modified width at the primary exit that is less than an unmodified width of the unmodified secondary volute at the primary exit.

4. The housing of claim 2, wherein the modified secondary volute generates a modified static pressure on the impeller of the centrifugal blower that is greater than an unmodified static pressure generated on the impeller by the unmodified secondary volute.

5. The housing of claim 2, wherein the modified secondary volute generates a modified primary pressure at the primary exit that is greater than an unmodified primary pressure generated at the primary exit by the unmodified secondary volute.

6. The housing of claim 1, further comprising an actuator coupled to the moveable flap, wherein the actuator causes the moveable flap to pivot from the closed position to the open position upon a determination that the primary exit is being at least partially obstructed.

7. The housing of claim 1, wherein the moveable flap has a width that extends substantially between a first cover and a second cover of the housing.

8. The housing of claim 1, wherein the second wall and the fourth wall meet at the volute tongue.

9. A centrifugal blower for use in an electronic device, the centrifugal blower comprising:

an impeller; and a housing enclosing the impeller, the housing comprising:

a first wall and a second wall forming a primary exit;

a third wall and a fourth wall forming a secondary exit;

a volute tongue between the second wall and the fourth wall; and a moveable flap pivotally coupled at the volute tongue and extending toward the primary exit, wherein the moveable flap is configured to pivot between a closed position in which the moveable flap is flat against an interior surface of the second wall and an open position that defines an open angle between the moveable flap and the second wall.

10. The centrifugal blower of claim 9, wherein the first wall and the impeller of the centrifugal blower define a primary volute, the moveable flap in the closed position and the impeller define a portion of an unmodified secondary volute, and the moveable flap in the open position and the impeller define a portion of a modified secondary volute.

11. The centrifugal blower of claim 10, wherein the portion of the modified secondary volute has a modified width at the primary exit that is less than an unmodified width of the unmodified secondary volute at the primary exit.

12. The centrifugal blower of claim 11, wherein the modified secondary volute generates a modified static pressure on the impeller that is greater than an unmodified static pressure generated on the impeller by the unmodified secondary volute.

13. The centrifugal blower of claim 10, wherein the modified secondary volute generates a modified primary pressure at the primary exit that is greater than an unmodified primary pressure generated at the primary exit by the unmodified secondary volute.

14. The centrifugal blower of claim 9, wherein the centrifugal blower generates a first sound pressure level when operating at a given power with the moveable flap in the closed position, and the centrifugal blower generates a second sound pressure level substantially equivalent to the first sound pressure level when operating at the given power with the moveable flap in the open position.

15. A method of increasing static pressure in a centrifugal blower comprising a primary volute, a secondary volute, a first wall and a second wall forming a primary exit, a third wall and a fourth wall forming a secondary exit, a volute tongue between the second wall and the fourth wall, and a moveable flap pivotally coupled at the volute tongue adjacent to the secondary volute and extending toward the primary exit, wherein the moveable flap is configured to pivot between a closed position in which the moveable flap is flat against an interior surface of the second wall and an open position that defines an open angle between the moveable flap and the second wall, the method comprising:

producing an unmodified static pressure in the centrifugal blower by operating the blower with the moveable flap in the closed position that at least partially defines an unmodified secondary volute; and producing a modified static pressure in the centrifugal blower greater than the unmodified static pressure by operating the blower with the moveable flap pivoted to the open position that at least partially defines a modified secondary volute.

16. The method of claim 15, further comprising:

sensing an obstruction at the primary exit of the centrifugal blower; and at least on condition of sensing the obstruction, pivoting the moveable flap to the open position to produce the modified static pressure in the centrifugal blower.

17. The method of claim 16, wherein producing the modified static pressure comprises pivoting the moveable flap to reduce a width of the primary exit.

18. The method of claim 15, further comprising maintaining airflow through the primary exit and the secondary exit of the centrifugal blower while operating the blower with the moveable flap pivoted to the open position that at least partially defines the modified secondary volute.

* * * * *